United States Patent [19]
Propst et al.
[11] 4,290,369
[45] Sep. 22, 1981

[54] STACKING PALLET

[75] Inventors: Robert L. Propst, Bellvue, Wash.; William B. Raftery, Grandville, Mich.

[73] Assignee: Herman Miller, Inc., Zeeland, Mich.

[21] Appl. No.: 81,536

[22] Filed: Oct. 3, 1979

[51] Int. Cl.[3] ..... B65D 19/26; B65D 19/40
[52] U.S. Cl. ..... 108/53.3; 108/56.3; 108/901
[58] Field of Search ..... 108/53.3, 53.1, 51.1, 108/51.3, 56.3, 56.1, 57.1, 901, 902; 206/386, 599, 600, 505, 511

[56] References Cited

U.S. PATENT DOCUMENTS

| | | | |
|---|---|---|---|
| 3,269,336 | 8/1966 | Naylor et al. | 108/901 X |
| 3,272,158 | 9/1966 | Barnum | 108/53.3 |
| 3,294,040 | 12/1966 | Gregoire | 108/53.3 |
| 3,590,751 | 7/1971 | Freid et al. | 108/56.3 X |
| 3,605,651 | 9/1971 | Stewart | 108/56.3 |

FOREIGN PATENT DOCUMENTS

| | | | |
|---|---|---|---|
| 1456807 | 1/1969 | Fed. Rep. of Germany | 108/53.3 |
| 2132132 | 1/1972 | Fed. Rep. of Germany | 108/53.3 |

*Primary Examiner*—William E. Lyddane
*Attorney, Agent, or Firm*—Olsen and Stephenson

[57] ABSTRACT

A pallet consisting of a substantially flat body, a plurality of slots in the body and feet positioned in the slots. Each of the feet is readily molded from a suitable plastic and has an open upper end and a downwardly tapered cavity in which an internal support surface is formed. In stacking of pallets, the foot of the top pallet telescopes downwardly into the foot of the bottom pallet to a supported position on the internal support surface in which the pallet bodies are maintained in a spaced relation so that they can readily be separated when desired.

3 Claims, 3 Drawing Figures

STACKING PALLET

BACKGROUND OF THE INVENTION

This invention relates generally to pallets for material handling and specifically to expendable flat pallets. In the past, flat pallets have been used extensively in material handling and have proven reasonably effective. However, in stacking of pallets during storage or transport, it has been found that pallets tend to slip relative to each other and, furthermore, it is often difficult for a fork lift operator to guide the fork between pallets to remove a desired number of pallets from the stack. Efforts to rectify this situation have resulted in pallets with "feet" which make the pallet heavier, more complex, more difficult and costly to assemble and bulkier in storage. It is an object of the present invention, therefore, to provide an improved pallet assembly which is extremely simple to construct and assemble, limits relative movement of pallets in a stack, provides for spaces between stacked pallets while retaining compactness in storage, and is low in cost and light in weight.

SUMMARY OF THE INVENTION

The pallet of this invention has a generally rectangular body with slots provided in the corners. The body is preferably made of an inexpensive material such as particle board, wood chip board, wood, plastic, or similar rigid material. The pallet further includes identical feet which are positioned in the slots and are readily manufactured in large numbers because they are all the same. Each foot has an open upper end, body structure forming a downwardly tapered cavity, a bottom wall underlying the cavity and an internal support surface located in the cavity at a position upwardly displaced from the bottom wall.

In stacking of pallets one on another, the feet of an upper pallet telescope downwardly into the feet of an adjacent lower pallet so that the bottom walls on the upper feet are supported by the internal support surfaces on the lower feet. Relative horizontal movement of stacked pallets is prevented by this telescoping arrangement while the pallet bodies are maintained in a vertically spaced relation. A lift truck fork can be easily guided between the pallet bodies to remove a desired number of pallets from the stack.

The present invention overcomes the problems inherent in the use of flat pallets while remaining low in cost, since the feet can be cast from a single mold and slots are easily formed in the pallet bodies. The body and feet are easy to assemble, since the feet are simply slid into the slots and secured with a suitable adhesive.

Figure 1:
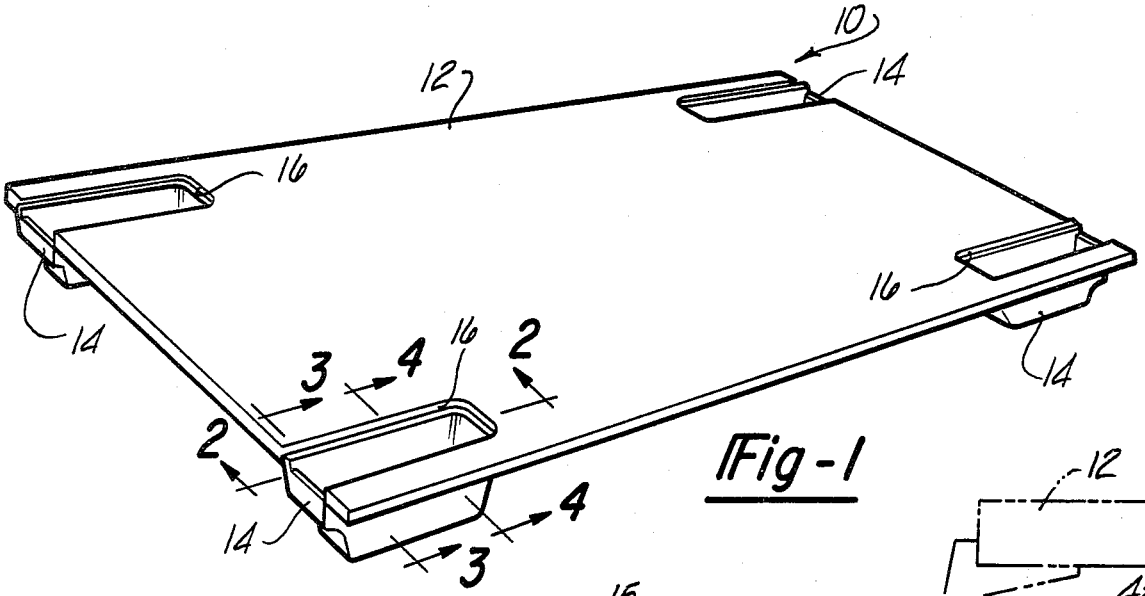
Figure 2:
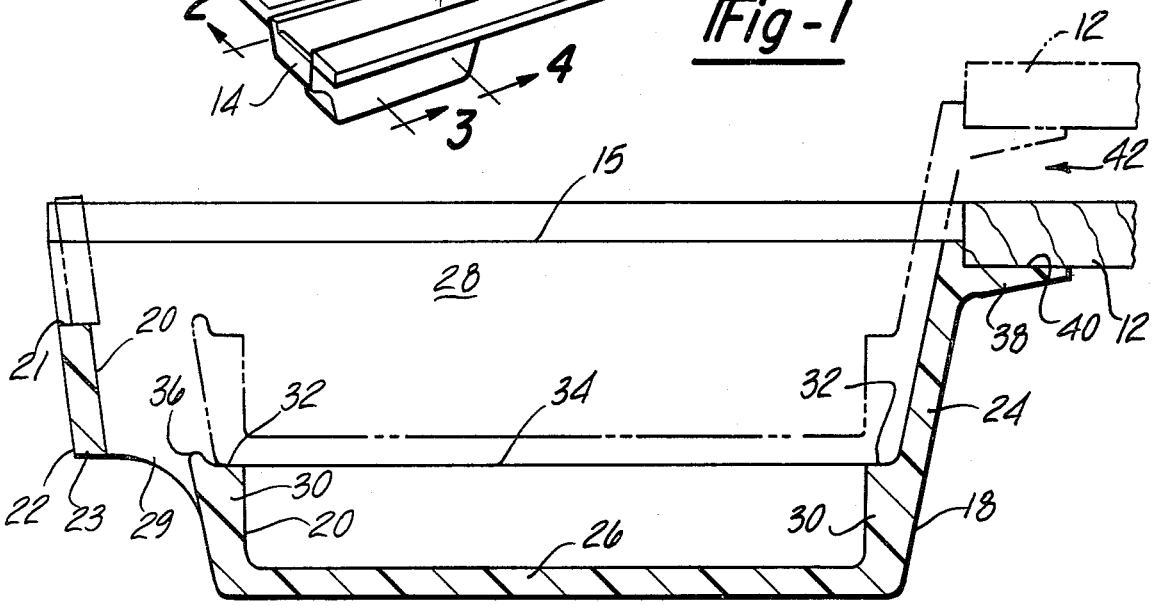
Figure 3:
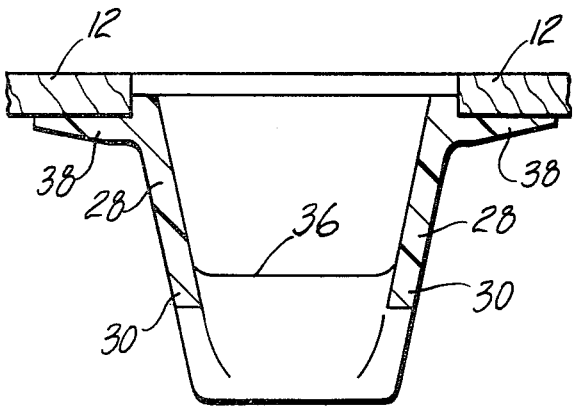
Figure 4:
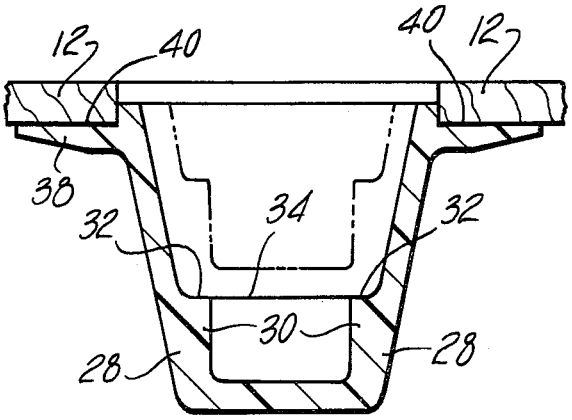

Further objects, features, and advantages of the invention will become apparent from a consideration of the following description, the appended claims and the accompanying drawing in which:

FIG. 1 is a perspective view of the pallet of this invention;

FIG. 2 is an enlarged transverse sectional view of a portion of the pallet taken from substantially the line 2—2 in FIG. 1 and showing in broken lines the stacked relationship of feet on adjacent pallets; and FIGS. 3 and 4 are detailed sectional views of portions of the pallet as seen from substantially the lines 3—3 and 4—4, respectively, in FIG. 1.

With reference to the drawing, the pallet of this invention, indicated generally at 10, is shown in FIG. 1 as including a substantially flat rectangualar load-carrying body 12 and a plurality of identical feet 14 secured to the body 12. The feet 14 are positioned in generally rectangular slots 16 formed in the body 12 preferably at the corners thereof. As seen in FIG. 2, each foot 14 has an open upper end, indicated at 15, a downwardly tapered external surface 18 and a similarly tapered internal surface 20.

The foot 14 includes a front wall 22 which is inclined downwardly and inwardly and has a top end 21 and a bottom end 23. The foot 14 also includes a back wall 24 which is inclined downwardly and inwardly toward the front wall 22, a bottom wall 26 which is substantially horizontal and extends between the back wall 24 and a position spaced from the front wall 22, and a pair of side walls 28 which are also inclined downwardly and inwardly toward each other. A bottom opening 29 is formed between an upright flange 30 formed at the forward end of the bottom wall 26 and the front wall 22 for a purpose explained hereafter.

An internal support surface 34, which is substantially horizontal, is formed on the inner surface 20 at a position to form a continuation of the upper end 32 of the flange 30. In the preferred embodiment of the invention, the surface 34 extends along the back wall 24, each of the side walls 28, and between the side walls 28 at the upper end 32 of the flange 30. A lip 36 is provided on the upper end 32 of the flange 30 for a purpose to appear presently.

A mounting flange 38 is formed on the foot 14 at a position projecting outwardly from the back wall 24 and the side walls 28. The flange has an upwardly facing top surface 40 spaced below the upper end 15 of the foot 14. In the assembly of the feet 14 with the slotted body 12, a suitable adhesive is applied to the flange surfaces 40. The feet upper ends 15 are then slid into the slots 16 so that the ends 15 of the feet 14 are aligned with the slots 16 and project upwardly into the slots 16, as shown in FIGS. 2–4, inclusive. The surfaces 40 are firmly pressed against the bottom surface of the body 12 to secure the feet 14 to the body 12.

The pallet 10 is constructed so that a plurality of empty pallets can readily be stacked for compact storage or shipment. During stacking, the legs 14 on an upper pallet 10 are set downwardly into the open upper ends 15 of the feet 14 on a lower pallet 10. This process is repeated as many times as necessary to achieve a stack of a desired size. The internal support surface 34 is displaced upwardly a predetermined distance from the bottom wall 26 so that in stacking of pallets one on another, as illustrated in FIGS. 2 and 4, the feet 14 on an upper pallet 10 telescope downwardly into the feet 14 on an adjacent lower pallet 10 to a position in which the upper pallet bottom wall 26 is supported on the lower pallet internal support surface 34. The upper pallet back wall 24, side walls 28, and front wall 22 are adjacent the lower pallet back wall 24, side walls 28, and front wall 22 so that the stacked pallets 10 are restrained against relative horizontal movement in three directions. The lip 36 on the lower pallet 10 is engageable with the bottom wall flange 30 of the upper pallet 10 to restrain relative horizontal movement in a fourth direction. The support surface 34 is spaced a predetermined distance above the bottom wall 26 to achieve this limitation in relative horizontal movement of pallets and in providing adequate load support for a stack of pallets. The displacement of the surface 34 from the bottom wall 26 also provides for a space 42 between pallet bodies 12 into which a lift truck fork is readily guided.

The opening 29 is provided on the pallet 10 to facilitate manual handling of the pallet 10 and to positively locate positions of other parts in the area of pallets 10.

This invention thus provides an improved pallet 10 having a body 12 and telescoping feet 14. The feet 14 have internal support surfaces 34 which locate stacked feet 14 relative to each other, provide support for pallets 10 in a stack, and also provide spaces 42 between stacked pallet bodies 12.

What is claimed is:

1. A pallet comprising a generally horizontal body having an outer edge and capable of carrying a load, means forming a plurality of body openings at predetermined locations in said body outer edge, and a plurality of substantially identical feet positioned in said body openings and secured to said body, each of said feet being provided with an open upper end, downwardly tapered side portions, and a generally horizontal bottom portion, means forming an internal support flange spaced above said bottom portion so that one of said feet is operable to telescope downwardly into another of said feet to a supported position wherein said bottom portion rests on the internal support flange therein, whereby an upper pallet can have its feet telescoped into and supported in the feet of a lower pallet with the pallet bodies being spaced apart vertically, and an opening formed by one side portion of each of said feet having a lower portion offset from and discontinuous with an upper portion, said opening forming a handle above said opening adjacent said body outer edge and facilitating location of the pallet with respect to parts and equipment.

2. The pallet according to claim 1 and further including means forming an upwardly extending lip on said support flange adjacent said opening said lip being provided to locate placement of said upper pallet bottom portion on said lower pallet support flange and provide further resistance to relative horizontal movement of said pallets.

3. The pallet according to claim 1 wherein said internal support flange is integral with said downwardly tapered side portions and each of said feet comprising a moldable, one-piece structure.

* * * * *